US006926121B2

(12) United States Patent
Gates et al.

(10) Patent No.: US 6,926,121 B2
(45) Date of Patent: Aug. 9, 2005

(54) OIL FILTER CAP WITH BALL VALVE ANTI-STICKING DEVICE

(75) Inventors: Roger Gates, West Hartford, CT (US); Ian MacFarlane, St. Bruno (CA)

(73) Assignee: Pratt & Whitney Canada Corp., Quebec (CA)

( * ) Notice: Subject to any disclaimer, the term of this patent is extended or adjusted under 35 U.S.C. 154(b) by 201 days.

(21) Appl. No.: 10/265,556

(22) Filed: Oct. 4, 2002

(65) Prior Publication Data

US 2004/0065512 A1 Apr. 8, 2004

(51) Int. Cl.[7] ..... G01F 23/04
(52) U.S. Cl. ..... 184/88.1; 33/731
(58) Field of Search ..... 184/1.5, 88.1, 184/105.1; 123/196 R; 33/722–731; 137/522, 523

(56) References Cited

U.S. PATENT DOCUMENTS

| | | | | | |
|---|---|---|---|---|---|
| 1,756,976 | A | | 5/1930 | Ehlers | |
| 3,311,984 | A | * | 4/1967 | Stux et al. | 33/718 |
| 3,662,470 | A | | 5/1972 | Sasgen | |
| 4,124,011 | A | | 11/1978 | Saito et al. | |
| 4,373,548 | A | | 2/1983 | Chou | |
| 4,651,428 | A | | 3/1987 | Allaria et al. | |
| H438 | H | | 3/1988 | Viksne et al. | |
| 4,991,434 | A | * | 2/1991 | Snow | 73/303 |
| 5,544,419 | A | | 8/1996 | Smeltzer | |
| 6,279,247 | B1 | * | 8/2001 | Neitzel | 33/727 |

FOREIGN PATENT DOCUMENTS

| | | | | |
|---|---|---|---|---|
| GB | 2275775 | A | * 9/1994 | G01F/23/04 |

* cited by examiner

*Primary Examiner*—Chong H. Kim
(74) *Attorney, Agent, or Firm*—Bachman & LaPointe, P.C.

(57) ABSTRACT

A cap for sealing an outer end of an oil filler tube of an engine where the oil filler tube has an inner end with ball valve having a float ball and mating valve seat for impeding any reverse flow of oil during engine operation. The cap includes a sealable plug mating the tube outer end; a rod extending from the plug toward the inner end of the tube; and a valve opening device mounted to the rod for dislodging the float ball from the valve seat.

10 Claims, 3 Drawing Sheets

OIL FILTER CAP WITH BALL VALVE ANTI-STICKING DEVICE

TECHNICAL FIELD

The invention relates to an oil filler cap, for mounting in an engine oil filler tube with a back flow preventing float ball valve, where the cap includes a device to prevent sticking of the ball in the valve seat.

BACKGROUND OF THE ART

Engines and other machines usually include an oil filler tube to check and modify the oil volume within an oil tank. In the case of aircraft engines, the oil tank is pressurized and loss of oil during flight leads to rapid overheating of the bearings and catastrophic engine failure. In the event that the oil filler tube cap has been improperly placed or omitted altogether, oil filler tubes include a ball valve to impede oil leakage.

U.S. Pat. No. 1,756,976 to Ehlers shows a float ball valve to prevent escape of oil. Another example is shown in U.S. Statutory Invention Registration No. H438 to Viksne et al. which includes a float ball valve to prevent overflow of fuel through a fuel sounding tube.

An acknowledged problem with ball valves is that the float ball often sticks to the valve seat after operation of the engine particularly when the oil tank is pressurized and the float ball is forced by pressure into engagement with the valve seat. The relatively light weight ball of the valve can be stuck to the valve seat due to the viscosity of the oil, surface tension of oil, a vacuum state may be created that maintains the ball in place or the ball may be slightly distorted due to the pressure applied to it during engine operation. The blockage of the filler tube by the float ball stuck to the valve seat creates difficulty in adding oil to the tank through the filler tube and may give the false impression that the oil tank is full once oil is poured into the blocked filler tube.

It is an object of the invention to provide an oil filler cap that include a device to automatically prevent sticking of the ball within the ball valve and eliminate the potential for human error in judging the volume of oil within the engine.

Further objects of the invention will be apparent from review of the disclosure, drawings and description of the invention below.

DISCLOSURE OF THE INVENTION

The invention provides a cap for sealing an outer end of an oil filler tube of an engine where the oil filler tube has an inner end with ball valve having a float ball and mating valve seat for impeding any reverse flow of oil during engine operation. The cap includes a sealable plug mating the tube outer end; a rod extending from the plug toward the inner end of the tube; and a valve opening device mounted to the rod for dislodging the float ball from the valve seat.

One example of a valve opening device is a resilient tip mounted to the inner end of the rod where the rod has a length sufficient to reach down the oil filler tube and dislodge the ball from the valve seat. In order to permit the ball valve to remain in operation, the resilient tip can be spring loaded or made of elastomeric material such that when the ball of the valve is under pressure or a back flow condition occurs, the ball valve is not prevented from properly seating in the valve seat to prevent oil leakage.

Another example of the valve opening device is a spring loaded piston mounted to the inner end of the rod with a sliding air retaining seal. The cap disengages the ball by delivering a pulse of compressed air when the piston is rapidly released on opening of the cap.

Therefore, the invention provides significant advantage over the prior art in automatically preventing sticking of the ball of the valve with a simple fail safe device.

DESCRIPTION OF THE DRAWINGS

In order that the invention may be readily understood, three embodiments of the invention are illustrated by way of example in the accompanying drawings.

Further details of the invention and its advantages will be apparent from the detailed description included below.

DETAILED DESCRIPTION OF PREFERRED EMBODIMENTS

Figures 1, 2:
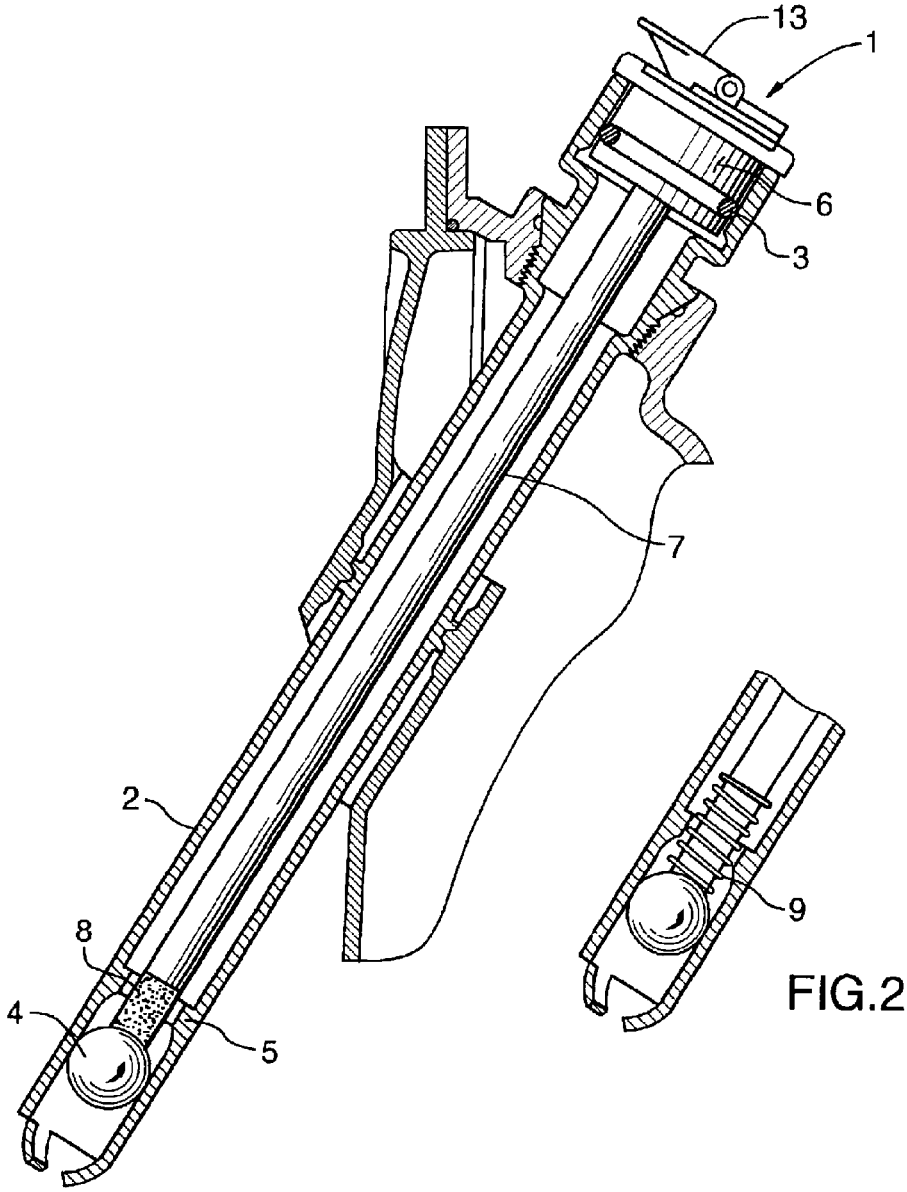
FIG. 1 in a longitudinal cross sectional view through an oil filler tube with a first embodiment of the oil filler cap having a rod of length sufficient to dislodge from the valve seat and having a resilient elastomeric tip.
FIG. 2 is a detailed view of a second embodiment where the resilient tip includes a coil spring around the inner end of the rod to dislodge the ball from the valve seat.

FIG. 1 illustrates a first embodiment of a cap 1 for sealing the outer end of an oil filler tube 2. A sealable plug 6 includes an O-ring 3 that together with the latch lever 13 secures the plug and prevents oil leakage. However, during maintenance operations replacement of the oil cap may be omitted or the O-ring 3 may be damaged. In some cases, such as ship or aircraft engines, loss of fuel or oil would be dangerous or catastrophic, a back up ball valve is provided to impede any reverse flow of liquids during engine operation. The ball valve includes a float ball 4 and a valve seat 5 with a concave spherical surface to match the convex spherical surface of the float ball 4.

In order to automatically dislodge the ball 4 from the valve seat 5 and avoid sticking, the invention includes a rod 7 that extends from the plug 6 towards the inner end of the tube 2. Valve opening means are mounted to the rod 7 for dislodging the ball 4 from the valve seat 5 as follows.

In the first embodiment shown in FIG. 1, a resilient tip 8 is mounted to the inner end of the rod 7. The rod 7 has a sufficient length so that the tip 8 engages the ball 4 and dislodges the ball 4 from the valve seat 5. In the first embodiment, the resilient tip 8 comprises an elastomeric material such as neoprene or rubber In the second embodiment shown in FIG. 2, the resilient tip comprises a coil spring 9. The resilient tip 8 made of elastomeric material and the coil spring 9 have resilience selected so they do not impede the normal operation of the ball valve. Rather the resilient tips have sufficient resilience to prevent the ball valve from sticking but can compress during normal engine operation to permit the ball valve to operate.

Figure 3:
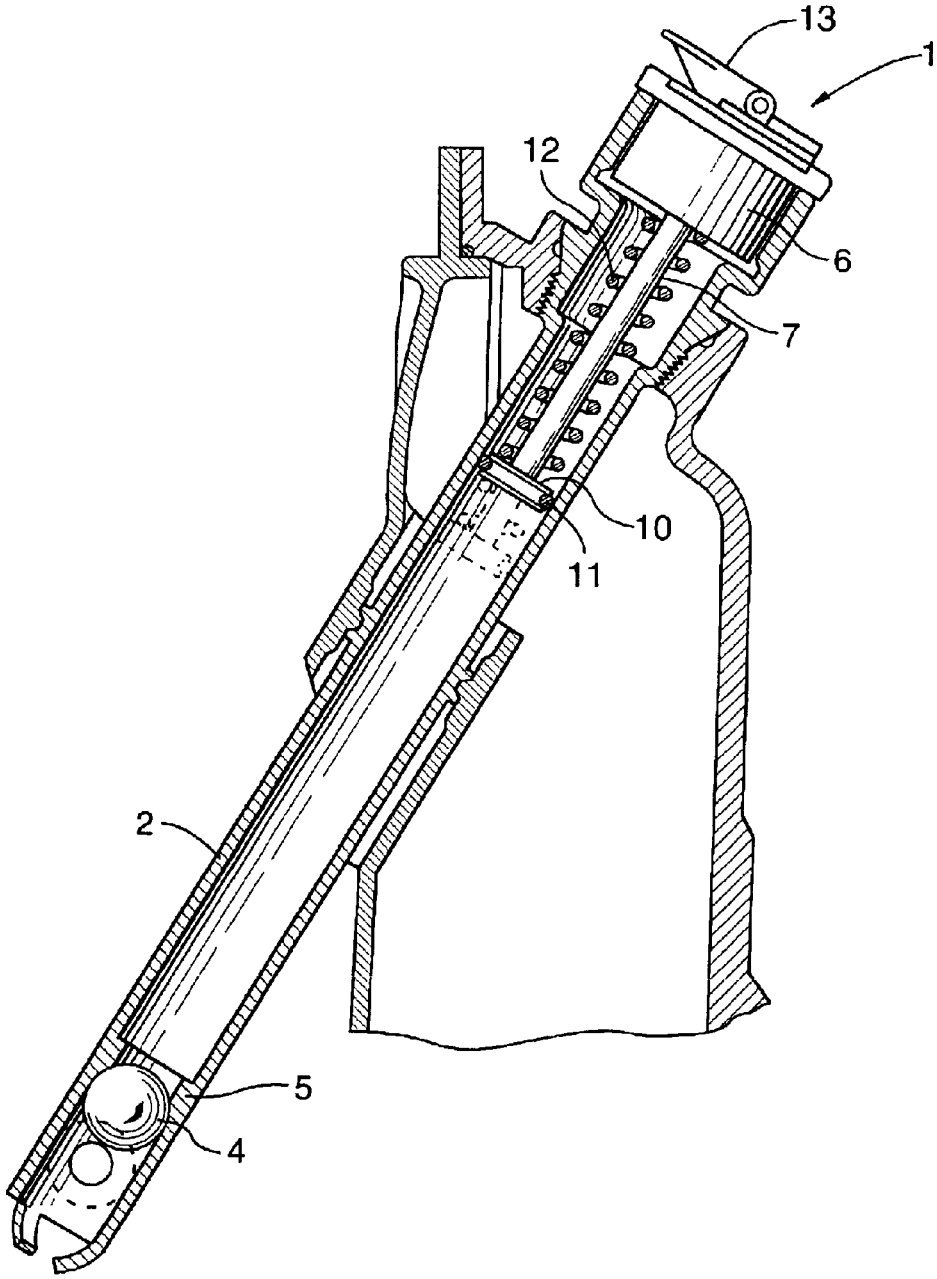
FIG. 3 is a like longitudinal cross section of view of the third embodiment of the invention showing a spring loaded piston with latch to deliver a pulse of compressed air down the oil filler tube when the cap is released to dislodge the float ball from the valve seat when the cap is removed.

FIG. 3 shows a third embodiment of the invention including a plug 6 where the rod 7 is slidably mounted for longitudinal motion within the tube 2. The device to disengage the ball 4 from the valve seat 5 includes a piston 10 with sliding air retaining O-ring seal 11 engaging the interior of the tube 2 when inserted. When the latch lever 13 is rotated, the spring loaded piston 10 snaps quickly to deliver a surge of pressurized air sufficient to dislodge the ball 4 from the ball seat 5. A compression spring 12 is coiled about the rod 7 confined between the piston 10 and the cap 1. The latch lever 13 is in a loaded position compressing the spring 12 when the piston 10 is disengaged from the interior of the tube 2. Therefore, when the cap 1 is replaced, the coil spring 12 is loaded as shown in dark outline in FIG. 3. The latch lever 13 when opened releases the piston 10 which moves to the position shown in dashed outline in FIG. 3 delivering a burst or surge or compressed air sufficient to dislodge the ball 4 from the valve seat 5.

Figure 4:
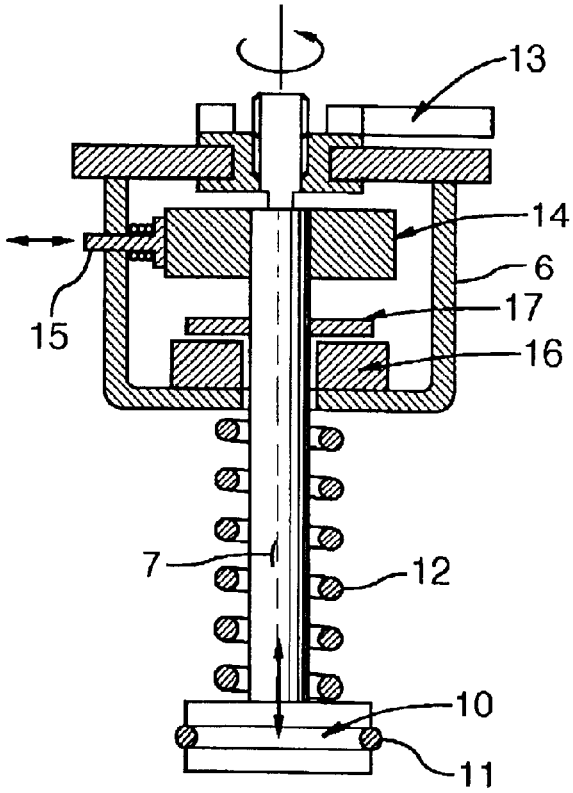
FIG. 4 is a detail longitudinal sectional view through the plug of the third embodiment showing: a central rotatable rod manually driven by the latch lever; a latch cam on the rod driving a lateral spring loaded latch pin; and a piston cam with piston cam follower on the rod to produce the up and down motion of the piston.

FIG. 4 is a detail longitudinal sectional view through the plug 6 of the third embodiment illustrating the means by which the relative positions of the latch cam and the piston cam are coordinated to produce the up/down motion of the piston as a result of the opening/closing of the latch when the latch lever 13 is rotated. The central rotatable rod 7 is manually driven by the latch lever 13 when opening the plug 6. The latch cam 14 fixed on the rod 7 drives the cam following head of a lateral spring loaded latch pin 15 to release and fix the plug 6. The piston cam 16 is fixed to the plug 6 and does not rotate. A piston cam follower 17 is fixed on the rod 7 and provides the up and down motion of the piston 10 as the rod 7 is rotated.

Figure 5:
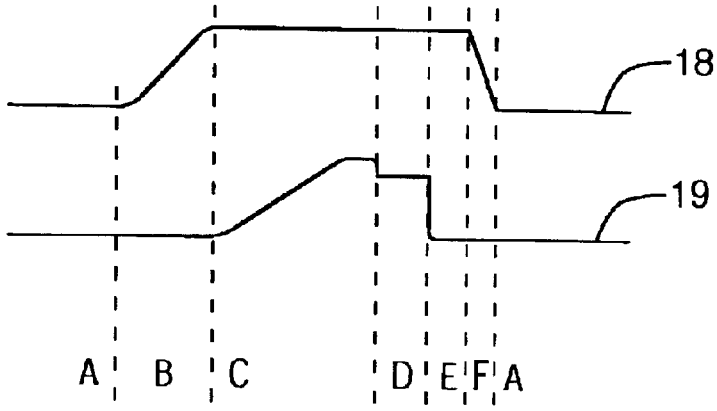
FIG. 5 is a diagram showing the relative positions of the latch cam and the piston cam to coordinate the up/down motion of the piston and the opening/closing of the latch.

FIG. 5 is a diagram showing the latch cam profile 18 and piston cam profile 19 (of the latch cam 14 and the piston cam 16) that coordinate the up/down motion of the piston 10 and the opening/closing of the latch pin 15 as the rod 7 is manually rotated by the latch lever 13. In the example shown, the resulting positions of the piston 10 and the latch pin 15 are summarized in Table 1 below:

TABLE 1

| Latch Lever (13) Position | Piston 10 Position | Latch Pin (15) Position |
|---|---|---|
| A | extended | open (pin 15 withdrawn) |
| B | extended | closing |
| C | withdrawing (compressing spring 12) | closed |
| D | armed (spring 12 compressed) | closed |
| E | released | closed |
| F | extended | open |

Although the above description relates to the specific preferred embodiments as presently contemplated by the inventor, it will be understood that the invention in its broad aspect includes mechanical and functional equivalents of the elements described herein.

We claim:

1. A cap for sealing an outer end of an oil filler tube of an engine, the oil filler tube having an inner end with ball valve means comprising a float ball and mating valve seat for impeding any reverse flow of oil during engine operation, the cap comprising:

a sealable plug mating an internal surface of the tube outer end;

a rod extending from the plug toward the inner end of the tube; and valve opening means mounted to the rod for dislodging the ball from the valve seat, the valve opening means comprising a resilient tip mounted to an inner end of the rod, the rod having a length wherein the tip engages the ball.

2. A cap according to claim 1 wherein the resilient tip comprises an elastomeric material.

3. A cap according to claim 1 wherein the resilient tip comprises a coil spring about the inner end of the rod.

4. A cap for sealing an outer end of an oil filler tube of an engine, the oil filler tube having an inner end with ball valve means comprising a float ball and mating valve seat for impeding any reverse flow of oil during engine operation, the cap comprising:

a sealable plug mating an internal surface of the tube outer end;

a rod extending from the plug toward the inner end of the tube, wherein the rod is slidably mounted to the cap; and valve opening means mounted to the rod for dislodging the ball from the valve seat, the valve opening means comprising a piston mounted to the inner end of the rod, the piston having a sliding air retaining seal engaging the tube when inserted therein.

5. A cap according to claim 4 including: a compression spring coiled about the rod confined between the piston and the cap; and latch means engaging the rod and cap for compressing the spring to a loaded position when the piston is placed into the tube and releasing the piston when the latch is opened.

6. An oil filler tube for an engine, comprising:

a hollow tube having an inner end, an outer end and an internal surface;

ball valve means, comprising a float ball and a mating valve seat disposed at the inner end of the oil filler tube, for impeding any reverse flow of oil during engine operation by floating of the ball upwardly and for permitting forward flow of oil during filling of oil from the inner end and out the outer end of the tube; and a cap having: a sealable plug mating the internal surface of the outer end of the oil filler tube; and a rod having an outer end connected to the plug and an inner end terminating in a resilient tip, wherein the rod has a length wherein the resilient tip engages the float ball to disengage the float ball from the valve seat in a cap closed position.

7. An oil filler tube according to claim 6 wherein the resilient tip comprises an elastomeric material.

8. An oil filler tube according to claim 6 wherein the resilient tip comprises a coil spring about the inner end of the rod.

9. A cap according to claim 1 wherein the resilient tip is compressible thereby enabling the ball of the valve to sealingly engage the valve seat.

10. An oil filler tube according to claim 6 wherein the resilient tip is compressible thereby enabling the ball of the valve to sealingly engage the valve seat.

* * * * *

UNITED STATES PATENT AND TRADEMARK OFFICE

CERTIFICATE OF CORRECTION

PATENT NO. : 6,926,121 B2 
DATED : August 9, 2005
INVENTOR(S) : Roger Gates and Ian Macfarlane It is certified that error appears in the above-identified patent and that said Letters Patent is hereby corrected as shown below:

Title page,
Item [54], Title, delete “FILTER” and insert -- FILLER --.

Signed and Sealed this

Twenty-seventh Day of September, 2005

JON W. DUDAS
*Director of the United States Patent and Trademark Office*